US009105416B2

(12) United States Patent
Yamanaka

(10) Patent No.: US 9,105,416 B2
(45) Date of Patent: Aug. 11, 2015

(54) PUSH SWITCH

(71) Applicant: HOSIDEN CORPORATION, Osaka (JP)

(72) Inventor: Satoshi Yamanaka, Osaka (JP)

(73) Assignee: HOSIDEN CORPORATION, Osaka (JP)

( * ) Notice: Subject to any disclaimer, the term of this patent is extended or adjusted under 35 U.S.C. 154(b) by 59 days.

(21) Appl. No.: 14/147,071

(22) Filed: Jan. 3, 2014

(65) Prior Publication Data

US 2014/0190812 A1 Jul. 10, 2014

(30) Foreign Application Priority Data

Jan. 8, 2013 (JP) ..... 2013-001019

(51) Int. Cl.

| | |
|---|---|
| ***H01H 3/02*** | (2006.01) |
| ***H01H 3/34*** | (2006.01) |
| ***H01H 3/50*** | (2006.01) |
| ***H01H 19/11*** | (2006.01) |
| *H01H 1/26* | (2006.01) |
| *H01H 1/40* | (2006.01) |
| *H01H 19/00* | (2006.01) |

(52) U.S. Cl.

CPC . *H01H 3/34* (2013.01); *H01H 3/50* (2013.01); *H01H 19/11* (2013.01); *H01H 1/26* (2013.01); *H01H 1/403* (2013.01); *H01H 19/003* (2013.01)

(58) Field of Classification Search

CPC . H01H 13/585; H01H 13/58; H01H 11/0006; H01H 13/023; H01H 13/52; H01H 13/74; H01H 17/165; H01H 1/403; H01H 2219/062; H01H 3/12; H01H 3/34; H01H 43/02

USPC ..... 200/526, 527, 528, 529, 16 R

See application file for complete search history.

(56) References Cited

U.S. PATENT DOCUMENTS

| | | | | |
|---|---|---|---|---|
| 4,891,476 | A * | 1/1990 | Nation et al. | 200/11 R |
| 5,145,059 | A * | 9/1992 | Park | 200/527 |
| 5,226,529 | A * | 7/1993 | Valenzona | 200/529 |
| 6,191,376 | B1 * | 2/2001 | Bartok | 200/529 |
| 6,621,028 | B1 * | 9/2003 | Bartok | 200/529 |
| 6,706,987 | B1 * | 3/2004 | Yoo | 200/529 |
| 7,514,643 | B1 * | 4/2009 | Tittle | 200/314 |
| 2009/0229958 | A1 * | 9/2009 | Koizumi et al. | 200/327 |

FOREIGN PATENT DOCUMENTS

| | | |
|---|---|---|
| JP | H02-072526 | 3/1990 |

* cited by examiner

*Primary Examiner* — Kyung Lee

(74) *Attorney, Agent, or Firm* — Greenblum & Bernstein, P.L.C.

(57) ABSTRACT

A rotor on which a moving contact is attached is received and rotatably held in a body, and a knob is received and held in the body side by side with the rotor and is movable. A plurality of first and second teeth are circumferentially staggered with each other on an outer perimeter surface of the rotor near one end and near the other end, respectively, in the direction of the axis of the rotor to project from the surface. An inclined surface is formed in each of the first and second teeth. A projecting part is formed on the knob to project toward the rotor. In response to a depression of the knob, the projecting part pushes the inclined surface of the second teeth to rotate the rotor and, in response to a return of the knob, pushes the inclined surface of the first teeth to rotate the rotor.

10 Claims, 11 Drawing Sheets

PUSH SWITCH

TECHNICAL FIELD

The present invention relates to an alternate push switch which is alternately turned on and off by a depression of a knob (a push button) to rotate a moving contact.

BACKGROUND ART

FIGS. 1 and 2 illustrates a configuration of an example of a conventional push switch of this type, which is disclosed in Japanese Patent Application Laid- Open No. H02-072526 (issued on Mar. 12, 1990). FIG. 1 is an exploded view of the switch. The switch 10 includes an actuator housing portion 11, a pushbutton 12, an actuator cam follower 13, a return spring 14, a rotary contact carrier 16 holding a rotary contact element 15, a stationary contract housing portion 18 provided with stationary contact elements 17, and an enclosure portion 19.

In this example, when the pushbutton 12 is depressed, the actuator cam follower 13 is moved downward to a predetermined position by the pushbutton 12, then rotates. The rotation rotates the rotary contact carrier 16 engaged with the actuator cam follower 13 to connect and disconnect a rotary contact portion of the rotary contact element 15 with a stationary contact portion of the stationary contact elements 17.

The rotation of the actuator cam follower 13 is caused by means of an offset of longitudinal axes of the pushbutton 12 and the teeth of the actuator cam follower 13 and cam surfaces provided on the pushbutton 12 and on the actuator cam follower 13. The rotary contact carrier 16 has a square-shaped stem 16*a* received within a square cavity formed in the actuator cam follower 13. The actuator cam follower 13 is free to move linearly over the stem 16*a*.

FIG. 2 illustrates the above-described switches 10 mounted on a circuit board 20. In FIG. 2, three switches 10 are mounted on the circuit board 20.

The pushbutton 12, the actuator cam follower 13 and the rotary contact carrier 16 which holds the rotary contact element 15 are arranged in a straight line and the actuator cam follower 13 and the pushbutton 12 are stacked in this order on the rotary contact carrier 16. Accordingly, the switch 10 inevitably has a high profile and is not able to meet the need for a demand for reducing the profile of this type of push switch.

SUMMARY OF THE INVENTION

An object of the present invention is to provide an alternate push switch that has a structure in which a moving contact rotates in response to a depression of a knob and has a significantly lower profile than conventional push switches.

According to the present invention, a push switch includes: a body having the shape of a box one face of which is open; a columnar rotor having a rotation axis perpendicular to the open face, the rotor being received and rotatably held in the body and including a plurality of first teeth and second teeth as many as the number of the first teeth, the first teeth being circumferentially arranged on an outer perimeter surface of the rotor near one end in the direction of the rotation axis and formed to project, the second teeth circumferentially arranged on the outer surface of the rotor near the other end in the direction of the rotation axis and formed to project, the first teeth and the second teeth being staggered with each other; stationary contacts arranged and formed on a circumference centered on the rotation axis on an inner bottom face of the body; a moving contact attached on one end face near the other end of the rotor and in sliding contact with the stationary contacts; a cover in contact with an end face near the one end of the rotor and covering the open face of the body; a knob including an operation part projecting outside through an opening formed in the cover and being configured to be depressed, a base part stopped by the cover from slipping out, and a projecting part formed to projecting from the base part toward the rotor, the knob being able to move in a direction perpendicular to the open face, being disposed side by side with the rotor, and being received and held in the body; and a spring urging the knob in the direction in which the knob projects through the opening; wherein a side surface of each of the second teeth on the one end side is a first inclined surface inclined so that the surface departs from an end face on the one end side in the direction opposite to the direction of rotation of the rotor; a side surface of each of the first teeth on the other end side is a second inclined surface inclined so that the surface departs from an end face on the other end side in the direction opposite to the direction of rotation of the rotor; a rear side surface of each of the first teeth is parallel to the direction of the rotation axis, the rear side surface continuing from the second inclined surface and located backward in the direction of the rotation; the projecting part in an initial state is positioned between adjacent ones of the first teeth at a height at which the rear side surface is positioned; and the projecting part pushes the first inclined surface to rotate the rotor in response to a depression of the knob and pushes the second inclined surface to rotate the rotor in response to a return of the knob.

In the push switch according to the present invention, a knob and a rotor that holds a moving contact and rotates by a depression of the knob are arranged side by side in a body, rather than being arranged in a straight line as in conventional push switches. Accordingly, the push switch has a significantly lower profile than conventional push switches.

In addition, in the push switch according to the present invention, up-and-down motion can be converted to rotary motion by only two components, namely the knob and the rotor. Accordingly, the push switch can be configured with fewer components and therefore with a lower cost than a configuration in which up-and-down motion is converted to rotary motion by using three components, namely a pushbutton, an actuator cam follower and a rotary contact carrier as in the example of conventional switches illustrated in FIG. 1.

DETAILED DESCRIPTION OF THE EMBODIMENTS

Embodiments of the present invention will be described below.

Figure 3A:
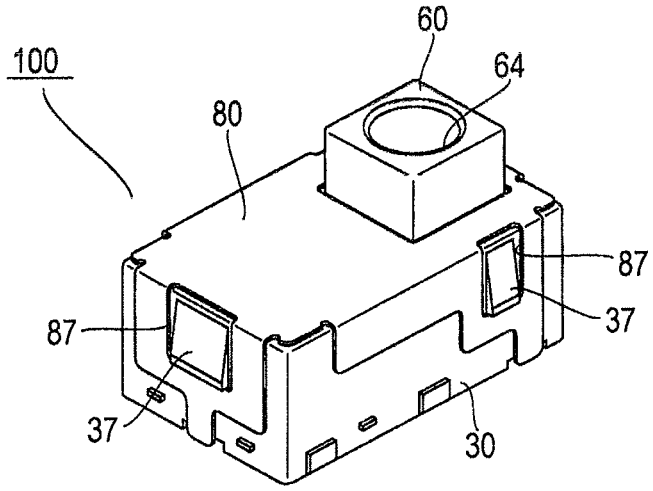
FIG. 3A is a perspective view of a first embodiment of a push switch according to the present invention.
Figure 3B:
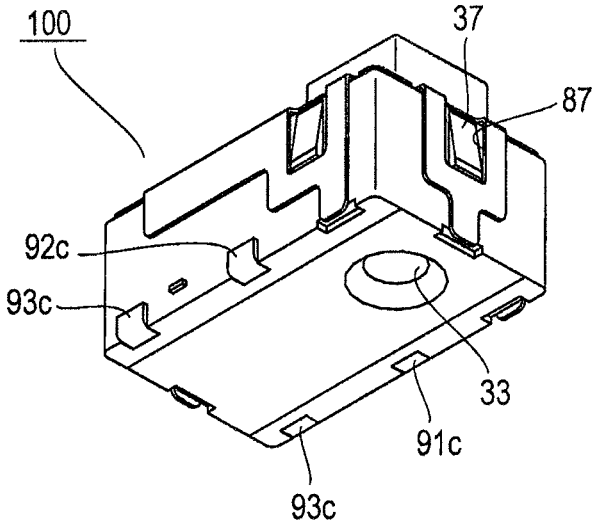
FIG. 3B is a perspective view of the push switch illustrated in FIG. 3A, viewed from below.
Figure 4:
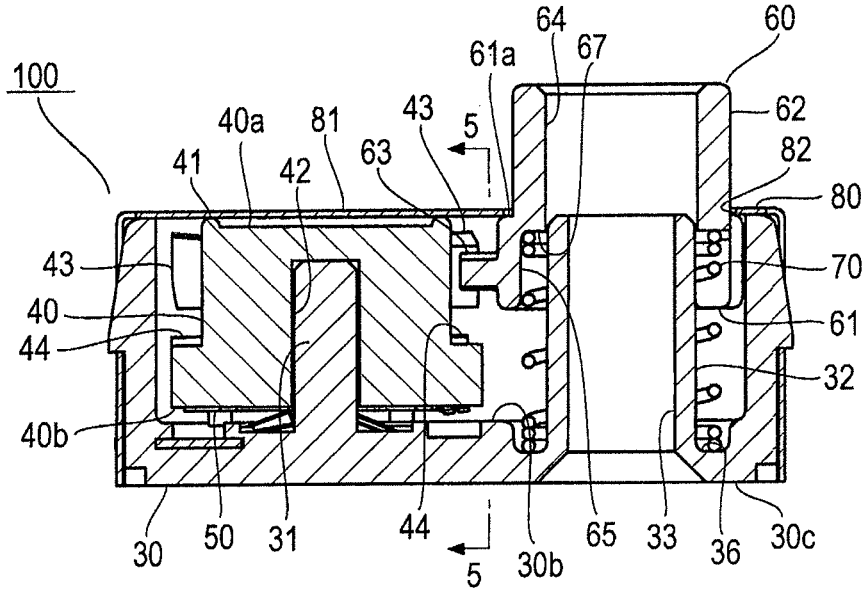
FIG. 4 is an enlarged cross-sectional view of the push switch illustrated in FIG. 3A.
Figure 5:
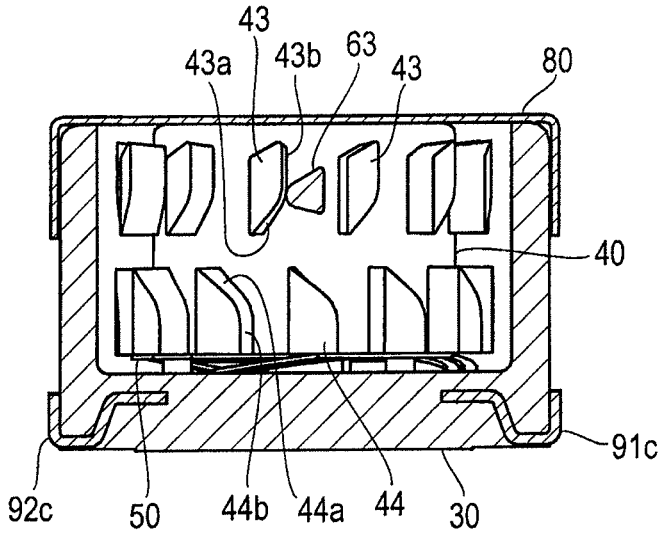
FIG. 5 is an enlarged cross-sectional view of the push switch illustrated in FIG. 3A, taken along line 5-5 in FIG. 4.
Figure 6:
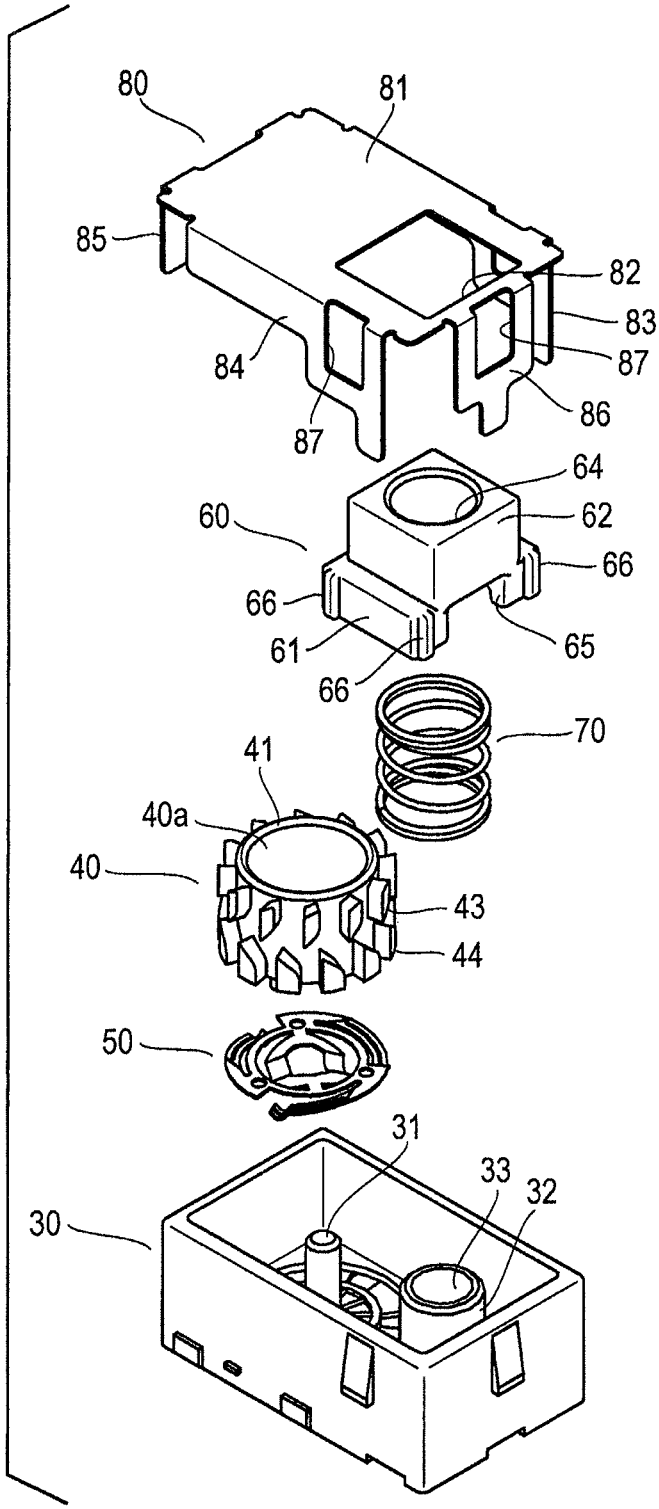
FIG. 6 is an exploded perspective view of the push switch illustrated in FIG. 3A.

FIGS. 3A and 3B illustrate external views of a first embodiment of a push switch according to the present invention. FIGS. 4 and 5 illustrate a cross-section structure of the push switch. FIG. 6 is an exploded view of the push switch. The push switch 100 in this example includes a body 30 in which stationary contacts are formed by insert molding, a rotor 40, a moving contact 50, a knob 60, a coil spring 70 and a cover 80. FIGS. 7A, 7B, 8A, 8B, 9A, 9B, 10A and 10B illustrate details of the body 30, the rotor 40, the moving contact 50, and the knob 60, respectively. Configurations of the components will be described first.

Figure 7A:
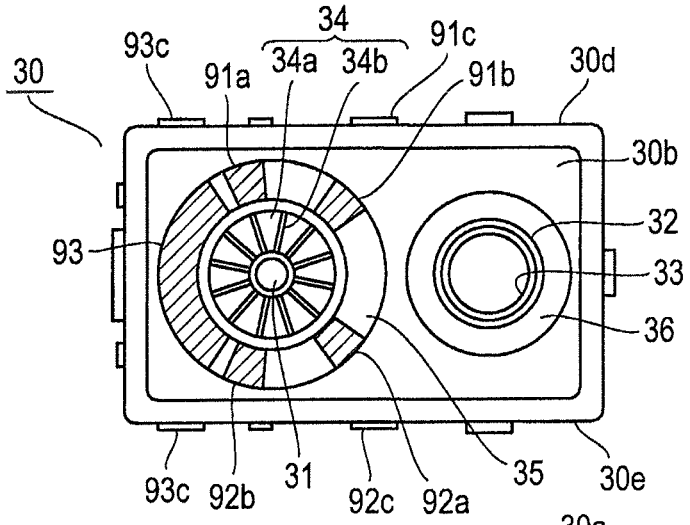
FIG. 7A is a plan view of a body in FIG. 6.
Figure 7B:
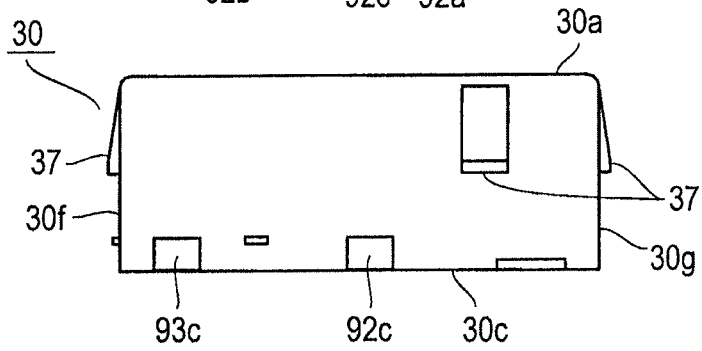
FIG. 7B is a front view of the body illustrated in FIG. 7A.

As illustrated in FIGS. 7A and 7B, the body 30 has the shape of a box one face (the upper face) 30*a* of which is open as illustrated in FIGS. 7A and 7B. In this example, the body 30 has the shape of a rectangular solid. On the inner bottom face 30*b* of the body 30, a rotor spindle 31 and a knob guide stem 32 are formed to project in parallel with each other in the direction perpendicular to the face 30*a*. The rotor spindle 31 is columnar and the knob guide stem 32 has the shape of a cylinder having a through-hole 33 that is open at the bottom face 30*c* of the body 30. The opening of the through-hole 33 at the bottom face 30*c* has the shape of a countersink as illustrated in FIG. 4.

Figure 12:
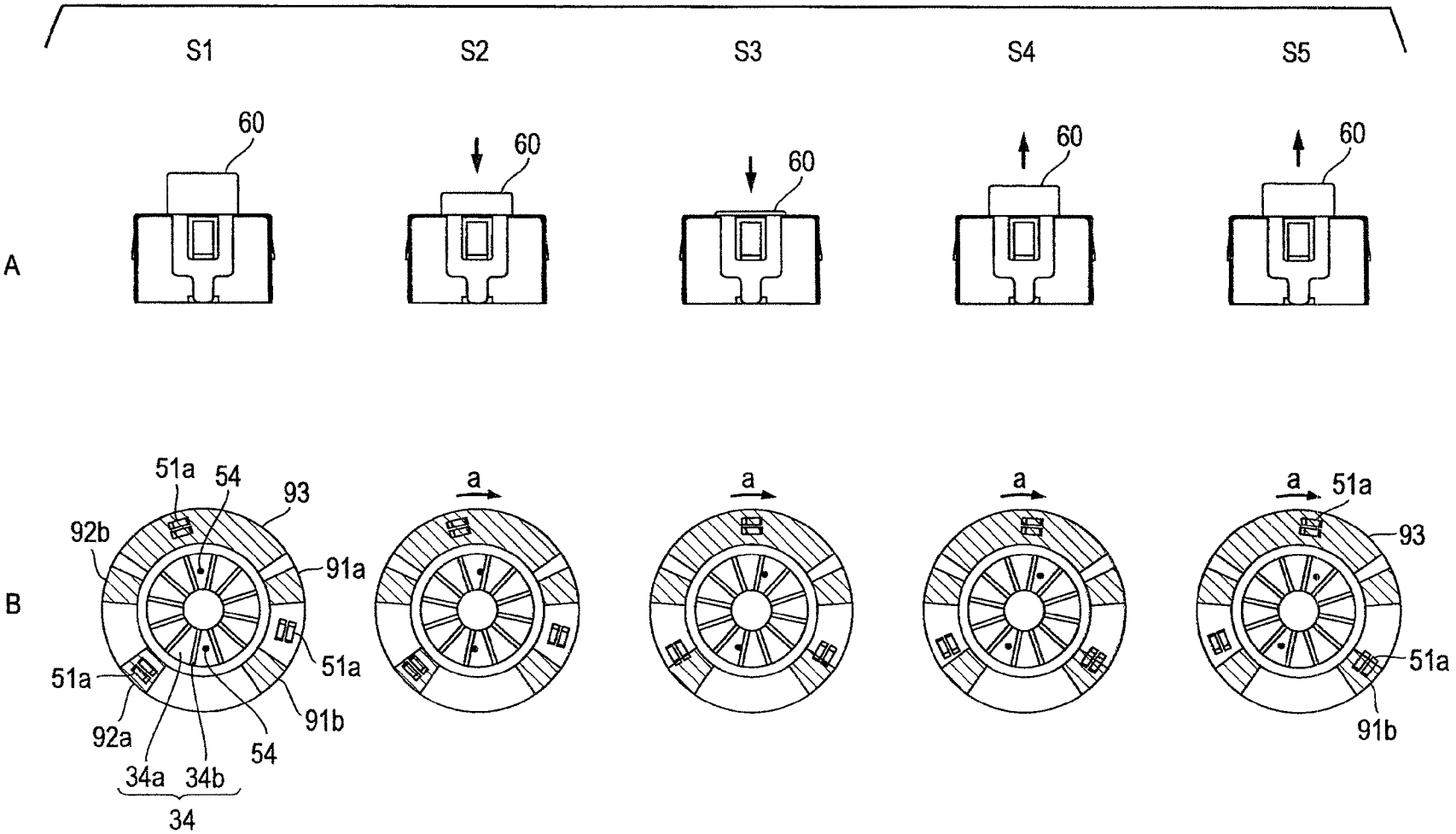
FIG. 12 is a diagram illustrating an operation of the push switch illustrated in FIG. 3A.

A ring-shaped recess 34*a* is formed around the rotor spindle 31 at the inner bottom face 30*b* of the body 30. A plurality of ridges 34*b* are radially formed in the recess 34*a*. The ridges 34*b* are narrow as illustrated in FIGS. 7A and 12 ridges are formed at equiangular intervals. The ridges 34*b* and recesses 34*a* form circumferentially arranged corrugations 34.

An additional ring-shaped recess 35 is formed at the inner bottom face 30*b* around the corrugations 34 and the stationary contacts 91*a*, 91*b*, 92*a*, 92*b* and 93 are disposed in the recess 35. The stationary contacts 91*a*, 91*b*, 92*a*, 92*b* and 93 are arranged on a circumference surrounding the rotor spindle 31 (centered on the axis of rotation of the rotor 40). The stationary contacts 91*a*, 91*b*, 92*a* and 92*b* have the shape of an arc having a small center angle while the stationary contact 93 has the shape of an arc having a large center angle.

The stationary contacts 91*a*, 91*b*, 92*a*, 92*b* and 93 are located at angular positions as follows: the stationary contact 91*a* is located at an angular position of 0°, for example, in FIG. 7A, the stationary contact 91*b* is at 60° clockwise from the stationary contact 91*a*, the stationary contact 92*a* is at 150°, the stationary contact 92*b* is at 210°, and that stationary contact 93 is located so that angular positions ranging from 240° to 330° are encompassed by the stationary contact 93. The upper faces (the exposed faces) of the stationary contacts 91*a*, 91*b*, 92*a*, 92*b* and 93 are located on the same plane as the bottom face of the recess 35.

The stationary contacts 91*a*, 91*b*, 92*a*, 92*b* and 93 are formed in the body 30 by insert molding. The stationary contacts 91*a* and 91*b* are integral with each other in the body 30. Similarly, the stationary contacts 92*a* and 92*b* are integral with each other in the body 30. A terminal 91*c*, which is formed integrally with the stationary contacts 91*a* and 91*b*, is extended and exposed from the bottom face 30*c* to a sidewall 30*d* of the body 30. A terminal 92*c*, which is formed integrally with the stationary contacts 92*a* and 92*b*, is extended and exposed from the bottom face 30*c* to a sidewall 30*e* of the body 30. Two terminals 93*c*, in this example, are formed integrally with the stationary contact 93. The terminals 93*c* are extended and exposed from the bottom face 30*c* to the sidewalls 30*d* and 30*e*, respectively.

Figure 8A:
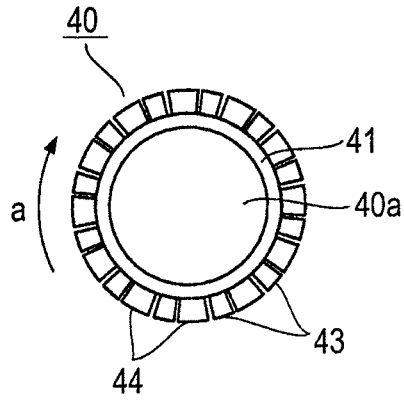
FIG. 8A is a plan view of a rotor in FIG. 6.
Figure 8B:
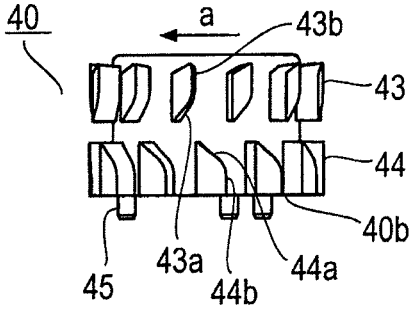
FIG. 8B is a front view of the rotor illustrated in FIG. 8A.

The rotor 40 is columnar as illustrated in FIGS. 8A and 8B and a ridge 41 is formed around the whole circumference of one end face (the upper face) 40*a*. An end of the ridge 41 is semicylindrical as illustrated in FIG. 4. On the other hand, a hole 42 (see FIG. 4) in which the rotor spindle 31 of the body 30 is inserted is formed in the center of the other end face (the lower face) of the rotor 40.

A plurality of first teeth 43 and second teeth 44 are formed on the outer perimeter surface of the rotor 40 to project from the surface. The first teeth 43 are formed circumferentially near the upper end (one end in the direction of the axis of rotation) of the rotor 40 and the second teeth 44 are formed circumferentially near the lower end (the other end in the direction of the axis of rotation) of the rotor 40. Twelve first teeth 43 and twelve second teeth 44 are formed with a pitch of 30° in this example. The first teeth 43 and the second teeth 44 are circumferentially staggered with each other, that is, arranged at an angle of 15° with respect to each other.

Arrow a in FIGS. 8A and 8B indicates the direction of rotation of the rotor 40. A side surface of each of the second teeth 44 on the upper end side is a first inclined surface 44*a* inclined in such a manner that the surface 44*a* departs from the upper face 40*a* of the rotor 40 in the direction opposite to the direction of rotation a of the rotor 40. On the other hand, a side surface of each of the first teeth 43 on the lower end side is a second inclined surface 43*a* inclined in such a manner that the surface 43*a* departs from the lower face 40*b* of the rotor 40 in the direction opposite to the direction of rotation a of the rotor 40. A rear side surface 43*b* of each of the first teeth 43 that continues from the inclined surface 43*a* and is located backward in the direction of the rotation a of the rotor 40 is parallel to the direction of the rotation axis of the rotor 40. In this example, a rear side surface 44*b* of each of the second teeth 44 that continues from the inclined surface 44*a* and is located backward in the direction of rotation a of the rotor 40 is also parallel to the direction of the rotation axis of the rotor 40.

Three bosses 45 for mounting the moving contact 50 is formed on the lower face 40*b* of the rotor 40 to project from the lower face 40*b*.

Figure 9A:
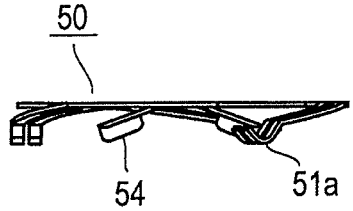
FIG. 9A is a front view of a moving contact in FIG. 6.
Figure 9B:
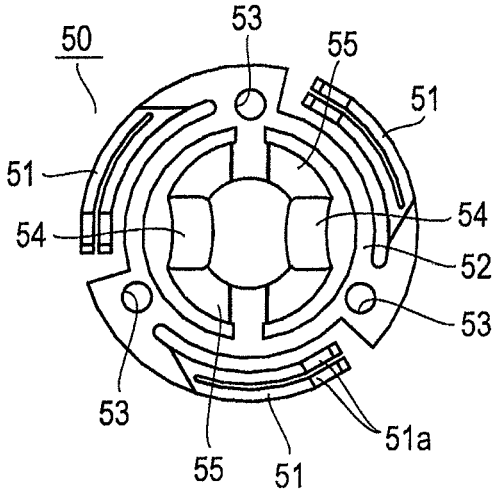
FIG. 9B is a bottom view of the moving contact illustrated in FIG. 9A.

The moving contact 50, which is in sliding contact with the stationary contacts 91*a*, 91*b*, 92*b*, 92*b* and 93, includes three sliding elements 51, in this example, as illustrated in FIGS. 9A and 9B. The sliding elements 51 are arc-shaped and are disposed outside a ring part 52 along the ring part 52 with a pitch of 120°. Each of the sliding elements 51 is split into two except in a base side part and a contact part 51*a* bent into an arc is formed at each tip.

Three mounting holes 53 are formed in the moving contact 50.

In this example, the two projecting parts 54 in sliding contact with the corrugations 34 formed on the body 30 are formed integrally with the moving contact 50. The projecting parts 54 are provided inside the ring part 52 and supported by a supporting part 55. The two projecting parts 54 are positioned at an angle of 180° with each other. The projecting parts 54 project in the direction in which the contact parts 51*a* of the sliding elements 51 project, as illustrated in FIG. 9A.

Figure 10B:
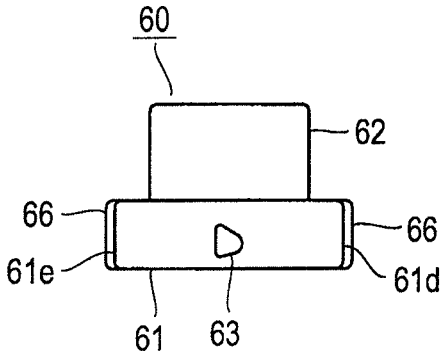
FIG. 10B is a left side view of the knob illustrated in FIG. 10A.
Figure 10A:
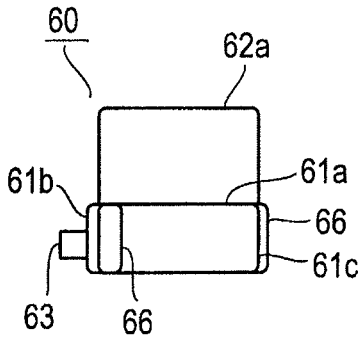
FIG. 10A is a front view of a knob in FIG. 6.

The knob 60 has a base part 61, an operation part 62 formed on the base part 61 to project from the base part 61 and can be depressed, and a projecting part 63 formed to project laterally from the base part 61 as illustrated in FIGS. 10A and 10B. The outside shape of the operation part 62 is prismatic and a circular through-hole 64 (see FIG. 4) is vertically formed in its center.

The base part 61 has the shape of a rectangular solid whose upper face 61*a* is larger than the upper face 62*a* of the operation part 62. A hole 65 (see FIG. 4) vertically passing through the base part 61 and having a diameter greater than the through-hole 64 of the operation part 62 is formed in the base part 61 concentrically with the through-hole 64 and communicates with the through-hole 64.

The projecting part 63 is formed in the center of one side surface 61*b* of the base part 61, has a wedge-shaped cross section, and the tip of the wedge is rounded into an arc. Note that the hole 65 opens in the side surface 61*c* opposite of a side surface 61*b* as illustrated in FIG. 6, so that the side surface 61*c* is cut out. Vertically extending ridges 66 are formed at both ends of the width of the side surface 61*c*. Similarly, a ridge 66 is formed at one end of the width of each of other sides 61*d* and 61*e*.

The cover 80 is a metal plate bent as illustrated in FIG. 6. A rectangular flat plate part 81 is large enough to cover the upper face 30*a* of the body 30 and a square opening 82 is formed in a half of the flat plate part 81. Leg parts 83 to 86 are provided at the four edges of the flat plate part 81 by bending the flat plate part 81 to a right angle. A latch window 87 is formed in each of the leg parts 83 to 86.

Assembly of the components will be described below.

The moving contact 50 is attached and secured on the lower face 40*b* of the rotor 40 by inserting bosses 45 of the rotor 40 in the three mounting holes 53 and caulking the tips of the bosses 45 with heat. The rotor 40 to which the moving contact 50 has been attached is placed in the body 30 and the rotor spindle 31 in the body 30 is inserted in the hole 42 formed in the lower face 40*b*, so that the rotor 40 is rotatably supported by the rotor spindle 31 as illustrated in FIG. 4.

On the other hand, a coil spring 70 is placed around the knob guide stem 32 in the body 30. The knob guide stem 32 passes through the coil spring 70, thereby positioning the coil spring 70 at the knob guide stem 32. Note that the lower end of the coil spring 70 is received and positioned in a ring-like recess 36 formed inner bottom face 30*b* of the body 30 around the knob guide stem 32.

The knob 60 is placed on the coil spring 70. The upper side of the coil spring 70 is received in the hole 65 formed in the base part 61 of the knob 60. The upper end of the coil spring 70 abuts against a step part 67 at the boundary of the through-hole 64 of the operation part 62. The upper end of the knob guide stem 32 is inserted and positioned in the through-hole 64.

Lastly, the cover 80 is attached to the body 30. The latch windows 87 formed in the four leg parts 83 to 86 of the cover 80 are latched at latch projections 37 formed on the sidewalls 30*d* to 30*g*, respectively, of the body 30, thereby the cover 80 is attached and secured on the body 30 and the upper face 30*a* of the body 30 is covered. The ridge 41 on the upper face 40*a* of the rotor 40 and the upper face 61*a* of the base part 61 of the knob 60 abut against the inner face of the cover 80, and the rotor 40 and the knob 60 are pressed by the cover 80. The operation part 62 of the knob 60 protrudes outward through the opening 82 of the cover 80.

In the push switch 100 having the configuration described above, the coil spring 70 sandwiched between the inner bottom face 30*b* of the body 30 and the knob 60 urges the knob 60 in the direction in which the knob 60 protrudes through the opening 82 of the cover 80. Note that the base part 61 of the knob 60 is stopped by the cover 80 from slipping out. The projecting part 63 of the knob 60 projects toward the rotor 40 as illustrated in FIG. 4. In the initial state illustrated in FIG. 4 (the state in which the knob 60 is not being operated), the projecting part 63 is positioned between adjacent ones of the first teeth 43 of the rotor 40 at the height at which the rear side surface 43*b* of the first teeth 43 are positioned as illustrated in FIG. 5. The knob 60 is vertically movable and moves up and down as the through-hole 64 is guided by the outer perimeter surface of the knob guide stem 32.

Operations of the push switch 100 described above will be described below.

Figure 11:
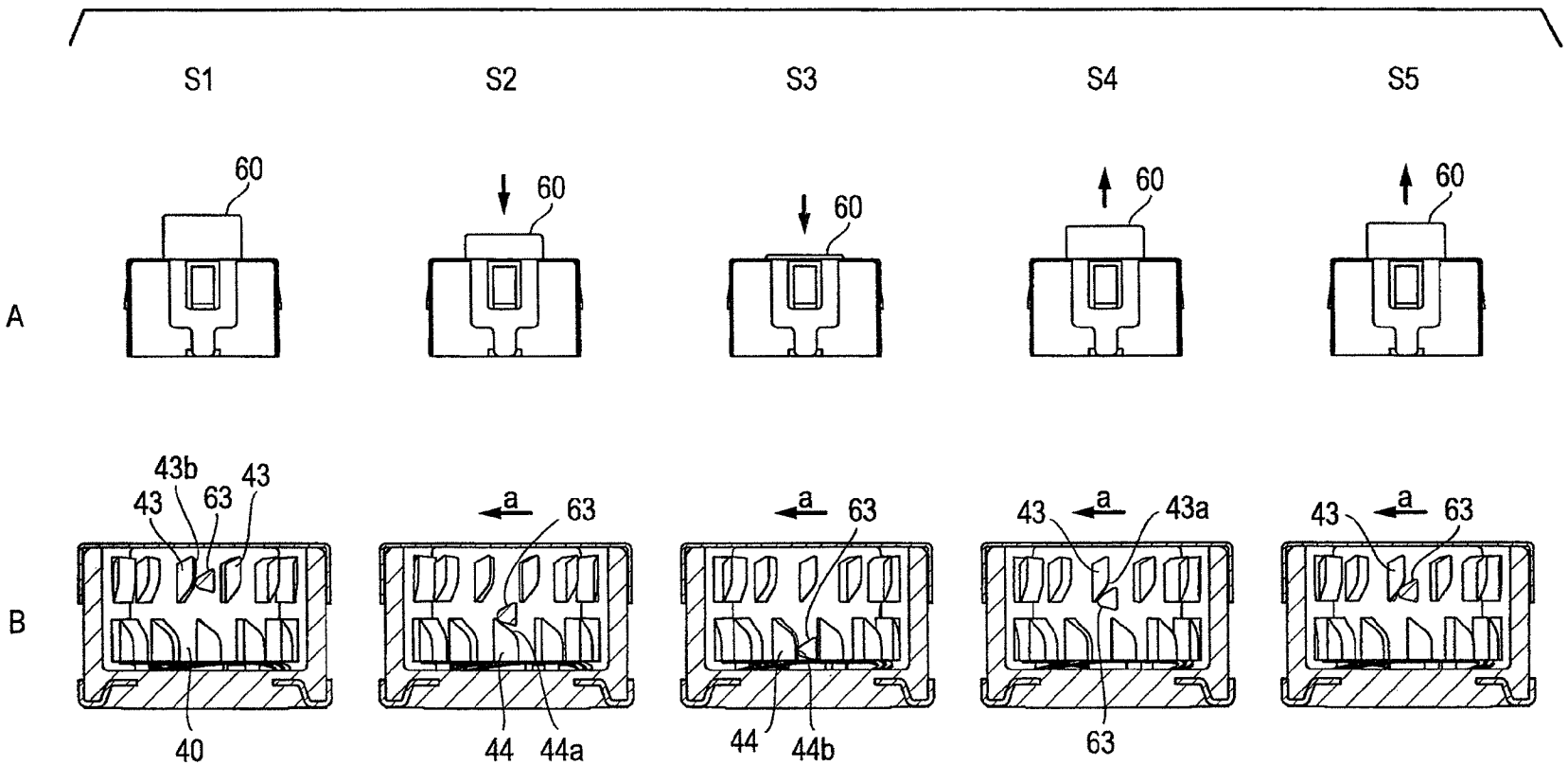
FIG. 11 is a diagram illustrating an operation of the push switch illustrated in FIG. 3A.

S1 to S5 of FIG. 11 illustrate step by step a rotary operation of the rotor 40 in response to a depression of the knob 60. In the initial state (where the knob 60 is not being operated) in S1 of FIG. 11, the projecting part 63 of the knob 60 is positioned between adjacent ones of the first teeth 43 of the rotor 40 as stated above. When the knob 60 is depressed, the projecting part 63 moves down and abuts against the inclined surface 44*a* of one of the second teeth 44 as illustrated in S2 of FIG. 11 and presses the inclined surface 44*a* to rotate the rotor 40 in the direction indicated by arrow a. S3 of FIG. 11 illustrates the knob 60 fully depressed.

S4 and S5 of FIG. 11 illustrate a sequence in which the depression of the knob 60 is released and the knob 60 is returned to the initial position by the resilient force of the coil spring 70. The projecting part 63 moves up to press the inclined surface 43*a* of one of the first teeth 43. This further rotates the rotor 40 in the direction indicated by arrow a. In this way, the rotor 40 rotates in response to either of a depression and a return operation of the knob 60. The rotor 40 in this example rotates 30° by one depression and one return operation, that is, the operations S1→S2→S3→S4→S5→S1 of FIG. 11.

S1 to S5 of FIG. 12 illustrate the positional relationships between the contact parts 51*a* of the moving contact 50 and the stationary contacts 91*a*, 91*b*, 92*a*, 92*b* and 93 and the positional relationships between the projecting parts 54 formed integrally with the moving contact 50 and the corrugations 34 of the body 30 in association with the operations S1 to S5 of FIG. 11 described above. The positions of the projecting parts 54 are indicated by black dots.

The push switch 100 in this example includes two circuits: one circuit 1 which includes the stationary contacts 91*a*, 91*b* and 93 (a common contact) and is turned on and off, and the other circuit C2 which includes the stationary contacts 92*a*, 92*b* and 93 and is turned on and off. The circuits C1 and C2 are alternately turned on and off when the knob 60 is depressed and are configured such that when the circuit C1 turns on, the circuit C2 turns off and when the circuit C1 turns off, the circuit C2 turns on. The operations will be described with reference to FIG. 12.

In the initial state in S1 of FIG. 12, the contact parts 51*a* are positioned on the stationary contacts 92*a* and 93, the circuit C2 is on and the circuit C1 is off As the rotor 40 rotates, the three contact parts 51*a* move as illustrated in S2→S3→S4→S5 of FIG. 12. When the knob 60 returns to the initial position after the depression and the return operation, the contact parts 51*a* are positioned on the stationary contacts 91*b* and 93. Accordingly, the circuit C2 is turned off and the circuit C1 is turned on. Each time the rotor 40 rotates 30°, the contact parts 51*a* are positioned on stationary contacts 92*b* and 93, then 91*a* and 93, then 92*a* and 93, and return to the positions in S1 of FIG. 12. With this rotation, the circuits C1 and C2 alternately turn on as C1: off, C2: on →C1: on, C2: off →C1: off, C2: on.

Each time the rotor 40 rotates 30°, the projecting parts 54, on the other hand, pass by one ridge 34*b* of the corrugations 34 and are positioned in the recesses 34*a* of the corrugations 34 in the initial position of the knob 60. This provides a good tactile response (an operation feel) when the knob 60 is depressed in this example and can restrict the positions of the rotor 40 and the contact parts 51*a*.

While the tactile response is provided by the corrugations 34 formed nearer the center than the stationary contacts 91*a*, 91*b*, 92*a*, 92*b* and 93 on the inner bottom face 30*b* of the body 30 and by the projecting parts 54 formed integrally with the moving contact 50 in the first embodiment described above, other configuration may be employed.

Figure 13:
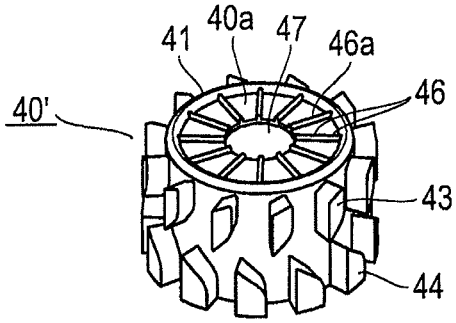
FIG. 13 is a perspective view illustrating a configuration of a rotor in a second embodiment of a push switch according to the present invention.
Figure 14A:
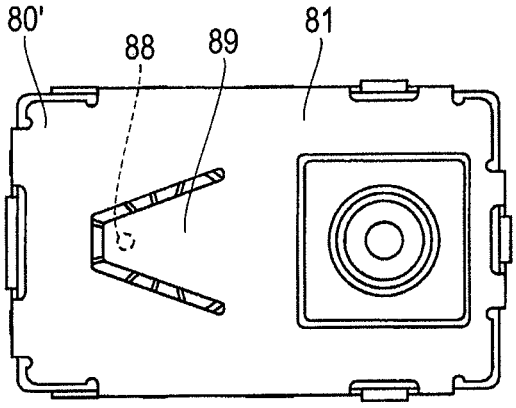
FIG. 14A is a plan view illustrating the second embodiment of the push switch according to the present invention.
Figure 14B:
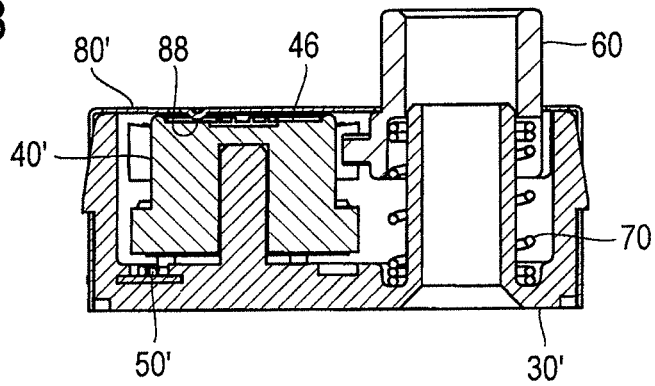
FIG. 14B is a cross-sectional view of the push switch illustrated in FIG. 14A.

FIGS. 13, 14A and 14B illustrate a second embodiment of the present invention that employs a configuration that provides a tactile response and is different from the configuration of the first embodiment.

In this example, corrugations 46 are formed in an upper face 40*a* of a rotor 40' as illustrated in FIG. 13 and a projecting part 88 which is in sliding contact with the corrugations 46 are formed in a cover 80' as illustrated in FIGS. 14A and 14B. The corrugations 46 of the rotor 40' are configured by radially forming a plurality of ridges 46*a* on the upper face 40*a* surrounded by a ridge 41. Thus, like the corrugations 34 in the first embodiment, the corrugations 46 arranged in the direction of a circumference centered on the axis of rotation are formed. In this example, 12 ridges 46*a* are formed at equiangular intervals. Note that a circular sunken recess 47 is formed in the center of the upper face 40*a* of the rotor 40'.

The projecting part 88 of the cover 80' is formed and projected inward at an end of an armature 89 formed by cutting in a flat plate part 81 as illustrated in FIG. 14A. The configuration illustrated in FIGS. 13, 14A and 14B may be employed as a configuration for providing a tactile response and restricting the positions of the rotor 40' and the contact parts 51*a*. Note that the body 30' in this example does not have corrugations 34 and a moving contact 50' does not have projecting parts 54 nor a supporting part 55.

A third embodiment of the present invention illustrated in FIG. 15 will be described next.

Figure 15:
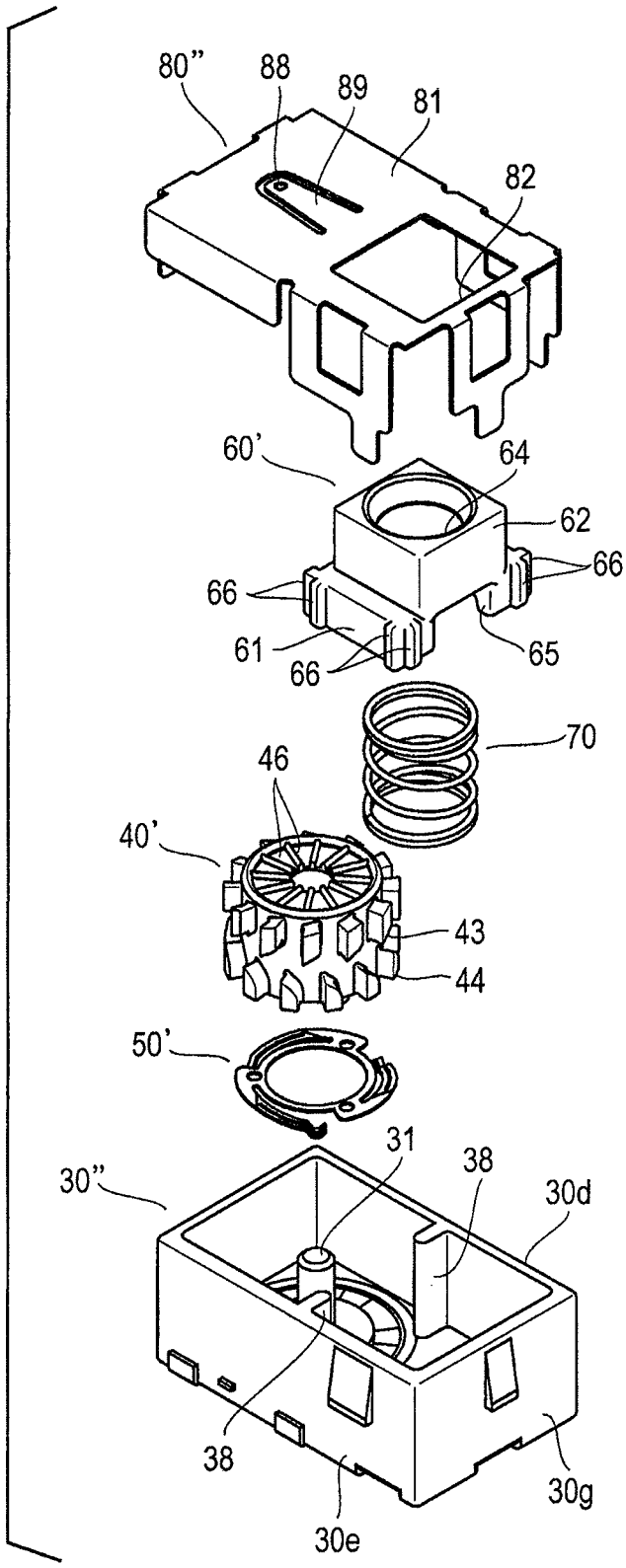
FIG. 15 is an exploded perspective view illustrating a third embodiment of a push switch according to the present invention.

FIG. 15 is an exploded view of the third embodiment of a push switch according to the present invention. In this example, a body 30" does not have a knob guide stem 32 and inner walls 38 are formed in the inner surfaces of opposed sidewalls 30*d* and 30*e* of the body 30" to project inward.

In this example, a knob 60' moves up and down while being positioned and guided by the inner surfaces of the sidewalls 30*d*, 30*e* and 30*g* of the body 30" and the pair of inner walls 38, rather than being guided by a knob guide stem 32. Vertically extending ridges 66 are formed at both ends of the width of each of the four side surfaces of the base part 61 of the knob 60'. The ridges 66 are opposed to and guided by the inner surfaces of the sidewalls 30*d*, 30*e* and 30*g* of the body 30" and the pair of inner walls 38. Note that a tactile response is provided by the projecting part 88 formed in the cover 88" and the corrugations 46 in the rotor 40' in this example as in the second embodiment.

While the knob 60' in FIG. 15 has a through-hole 64, the through-hole 64 may be omitted. Provision of the through-hole 64 in the knob 60' and provision of a through-hole in the body 30" that corresponds to the through-hole 64 enable implementation of an illuminated push switch, which will be described later, like the push switch 100 of the first embodiment. Note that while a knob guide stem 32 is omitted from the example, the knob guide stem 32 may be included in the configuration.

Figure 16A:
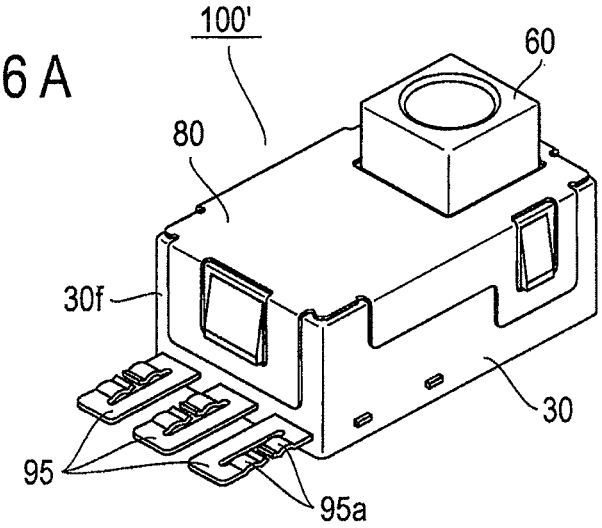
FIG. 16A is a perspective view illustrating a fourth embodiment of a push switch according to the present invention.
Figure 16B:
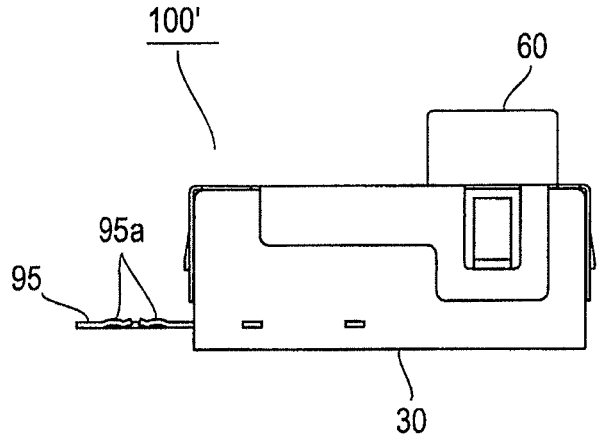
FIG. 16B is a front view of the push switch illustrated in FIG. 16A.

A fourth embodiment of the present invention illustrated in FIGS. 16A and 16B will be described next.

In the first embodiment, the terminals 91*c*, 92*c* and 93*c* of the push switch 100 are disposed at the bottom face 30*c* and sidewalls 30*d* and 30*e* of the body 30 and the push switch 100 is of SMD (surface mount device) type. Unlike the push switch 100, a push switch 100' illustrated in FIGS. 16A and 16B is of plug-in connection (mounting) type.

In this example, three plug-in terminals 95 are projected on a sidewall 30*f* of the body 30. The terminals 95 are led from stationary contacts 91*a*, 91*b*, 92*a*, 92*b* and 93 (see FIG. 7A). Note that each of the terminals 95 has a contact part 95*a* bent in a shape as illustrated in FIGS. 16A and 16 so as to provide a good contact pressure. This configuration can be used if the plug-in connection type is required.

While various embodiments of a push switch according to the present invention have been described, the structure supporting the rotor 40 (40') is not limited to the structure in which the rotor spindle 31 in the body 30 (30', 30") supports the rotor 40 (40'). For example, a structure may be employed in which a spindle is projected on each of the upper and lower faces 40*a* and 40*b* of the rotor 40 (40') and recesses facing the spindles may be provided in the inner bottom face 30*b* of the body 30 (30', 30") and the cover 80 (80', 80") so that the spindles of the rotor 40 (40') is rotatably supported by the recesses.

The push switches described above have the following advantageous effects.

(1) The knob 60 (60') to be depressed and the rotating rotor 40 (40') are received and held in the body 30 (30', 30") side by side and up-and-down motion is converted to rotary 60 motion by the projecting part 63 of the knob (60') and the first and second teeth 43 and 44 of the rotor 40 (40'). Thus, the structure in which the knob 60 (60') and the rotor 40 (40') are disposed side by side enables implementation of a low-profile push switch 100 (100').

Figure 1:
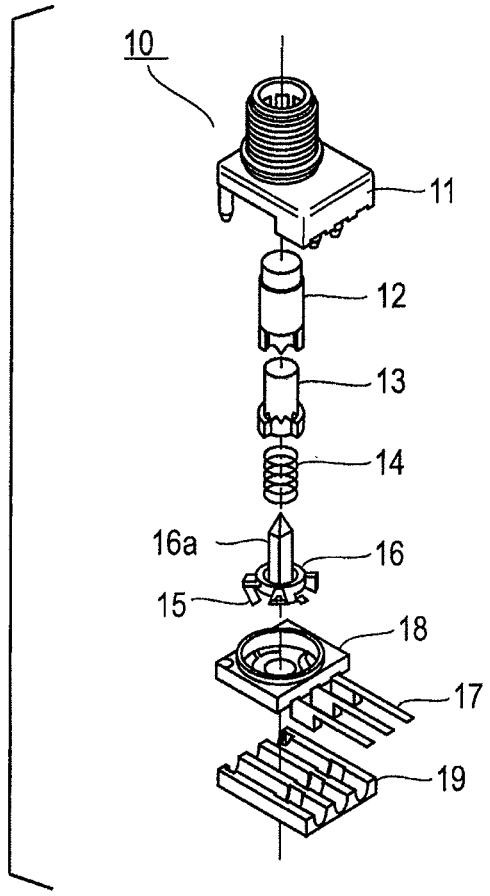
FIG. 1 PRIOR ART
FIG. 1 is an exploded perspective view illustrating a configuration of a conventional push switch.
Figure 2:
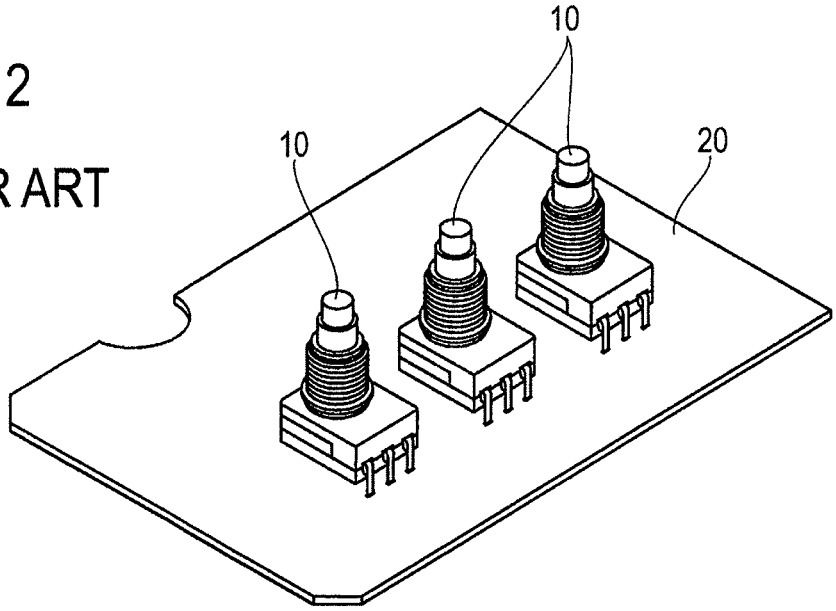
FIG. 2 PRIOR ART
FIG. 2 is a perspective view illustrating the push switch illustrated in FIG. 1 mounted on a circuit board.

(2) Only two component, namely the knob 60 (60') and the rotor 40 (40'), are involved in converting up-and-down motion to rotary motion, and the moving contact 50 (50') attached to the rotor 40 (40') turns on and off circuits. Accordingly, the push switch 100 (100') can be configured with fewer components and lower cost than the example of conventional push switch illustrated in FIG. 1. Note that insert-molding the moving contact in the rotor, for example, can further reduce the number of components.

(3) The push switch 100 (100') can be assembled simply by inserting the components in the body 30 (30', 30") in sequence.

(4) None of the body 30 (30', 30"), the rotor 40 (40') and the knob 60 (60'), which are made of resin, has an undercut part and can be made with upper and lower dies. Accordingly, the initial cost (the cost of dies) can be minimized.

(5) The knob 60 (60') is configured to abut against the inner bottom face 30*b* of the body 30 (30', 30") when the knob 60 (60') is depressed. Accordingly, the push switch 100 (100') can withstand an excess pressure and does not break down.

(6) The configuration of any of the first and second embodiments is capable of providing a good tactile response and restricting positions (signal positions) of the rotor 40 (40').

(7) The knob 60 has a through-hole 64 and the through-hole 33 is formed in the knob guide stem 32 of the body 30 (30') as well. The through-holes 33 and 64 form a light waveguide, which enables an illuminated push switch to be readily implemented simply by providing a light source on a circuit board, for example, on which the push switch 100 is mounted. The light source is positioned in the through-hole 33. Note that if a light waveguide is not needed, the knob guide stem 32 may have a smaller diameter and the knob 60 may be smaller, and therefore the push switch 100 can be made smaller. In the third embodiment having no knob guide stem 32, if a light waveguide is not needed, the push switch can further be made smaller.

(8) While the rotor 40 (40') rotates 30° by one operation of the knob 60 (60') in the embodiments, the angle of rotation made by one operation can be changed by changing the number of teeth of the first and second teeth 43 and 44 of the rotor 40 (40'). For example, increasing the number of teeth reduces the angle of rotation made by one operation and the distance over which the moving contact 50 (50') slide. Therefore the life of the push switch 100 (100') can be increased.

(9) The structure in which the knob 60 (60') and the rotor 40 (40') are disposed side by side enables implementation of a low-profile push switch 100 (100') as stated above and also can readily lengthen the stroke of the knob 60 (60'), for example.

What is claimed is:

1. A push switch comprising:

a body having the shape of a box one face of which is open;

a columnar rotor having a rotation axis perpendicular to the open face, the rotor being received and rotatably held in the body and including a plurality of first teeth and second teeth as many as the number of the first teeth, the first teeth being circumferentially arranged on an outer perimeter surface of the rotor near one end in the direction of the rotation axis and formed to project, the second teeth circumferentially arranged on the outer surface of the rotor near the other end in the direction of the rotation axis and formed to project, the first teeth and the second teeth being staggered with each other;

stationary contacts arranged and formed on a circumference centered on the rotation axis on an inner bottom face of the body;

a moving contact attached on one end face near the other end of the rotor and in sliding contact with the stationary contacts;

a cover in contact with an end face near the one end of the rotor and covering the open face of the body;

a knob including an operation part projecting outside through an opening formed in the cover and being configured to be depressed, a base part stopped by the cover from slipping out, and a projecting part formed to project from the base part toward the rotor, the knob being able to move in a direction perpendicular to the open face, being disposed side by side with the rotor, and being received and held in the body; and a spring urging the knob in the direction in which the knob projects through the opening;

wherein a side surface of each of the second teeth on the one end side is a first inclined surface inclined so that the surface departs from an end face on the one end side in the direction opposite to the direction of rotation of the rotor;

a side surface of each of the first teeth on the other end side is a second inclined surface inclined so that the surface departs from an end face on the other end side in the direction opposite to the direction of rotation;

a rear side surface of each of the first teeth is parallel to the direction of the rotation axis, the rear side surface continuing from the second inclined surface and located backward in the direction of the rotation;

the projecting part in an initial state is positioned between adjacent ones of the first teeth at a height at which the rear side surface is positioned; and the projecting part pushes the first inclined surface to rotate the rotor in response to a depression of the knob and pushes the second inclined surface to rotate the rotor in response to a return of the knob.

2. The push switch according to claim 1, wherein a knob guide stem guiding the knob is formed on the inner bottom face of the body to project from the inner bottom face.

3. The push switch according to claim 2, wherein the knob has a hole in which the knob guide stem is inserted and guided by an outer perimeter surface of the knob guide stem.

4. The push switch according to claim 3, wherein the hole is a through-hole; and a through-hole opened at a bottom face of the body is formed in the knob guide stem.

5. The push switch according to claim 3, wherein the spring is a coil spring positioned around the knob guide stem and sandwiched between the inner bottom face of the body and the knob.

6. The push switch according to claim 4, wherein the spring is a coil spring positioned around the knob guide stem and sandwiched between the inner bottom face of the body and the knob.

7. The push switch according to claim 1, wherein a rotor spindle supporting the rotor is formed on the inner bottom face of the body to project from the inner bottom face.

8. The push switch according to claim 2, wherein a rotor spindle supporting the rotor is formed on the inner bottom face of the body to project from the inner bottom face.

9. The push switch according to any one of claims 1 to 8, wherein corrugations are formed closer to the center than the stationary contacts on the inner bottom face of the body, the corrugations being arranged in the direction of a circumference and a projecting part in sliding contact with the corrugations is formed integrally with the moving contact.

10. The push switch according to any one of claims 1 to 8, wherein corrugations are formed in an end face on the one end side of the rotor, the corrugations being arranged in the direction of a circumference centered on the rotation axis; and a projecting part in sliding contact with the corrugation is formed in the cover.

* * * * *